US010299616B1

(12) United States Patent
Mitchell

(10) Patent No.: US 10,299,616 B1
(45) Date of Patent: May 28, 2019

(54) ZIPPER ASSISTANT DEVICE

(71) Applicant: Zoerene Mitchell, Lutz, FL (US)

(72) Inventor: Zoerene Mitchell, Lutz, FL (US)

( * ) Notice: Subject to any disclaimer, the term of this patent is extended or adjusted under 35 U.S.C. 154(b) by 0 days.

(21) Appl. No.: 15/499,974

(22) Filed: Apr. 28, 2017

(51) Int. Cl.
*A47G 25/90* (2006.01)

(52) U.S. Cl.
CPC ..... *A47G 25/902* (2013.01)

(58) Field of Classification Search
CPC ..... A47G 25/902; A44B 19/262; H01F 7/206; A47L 13/41
See application file for complete search history.

(56) References Cited

U.S. PATENT DOCUMENTS 4,105,239 A * 8/1978 Akczinski, Sr. ..... A47L 13/41 294/210
4,802,702 A * 2/1989 Bownds ..... A47L 13/41 294/210
7,228,819 B1 * 6/2007 Wang ..... A01K 1/0152 119/171
8,249,832 B2 * 8/2012 Motzer ..... G01N 21/9515 382/144
2015/0245725 A1 * 9/2015 Benjamin ..... A47G 25/902 294/3.6

* cited by examiner

*Primary Examiner* — Stephen Vu
(74) *Attorney, Agent, or Firm* — The Iwashko Law Firm, PLLC; Lev Ivan Gabriel Iwashko

(57) ABSTRACT

A zipper assistant device that provides consumers with an accessory to help conveniently zip-up their zippers which are often located on the back of clothing. The zipper assistant device includes an on and off switch having a casing, an ON button and an OFF button, the casing having a front facing and contains a battery to power the on and off switch, an elongated handle having a first end and a second end, the on and off switch attached to the first end of the elongated handle, a handle base attached to the second end of the elongated handle and a bulb-shaped magnetic field element attached to the handle base opposite the elongated handle.

6 Claims, 1 Drawing Sheet

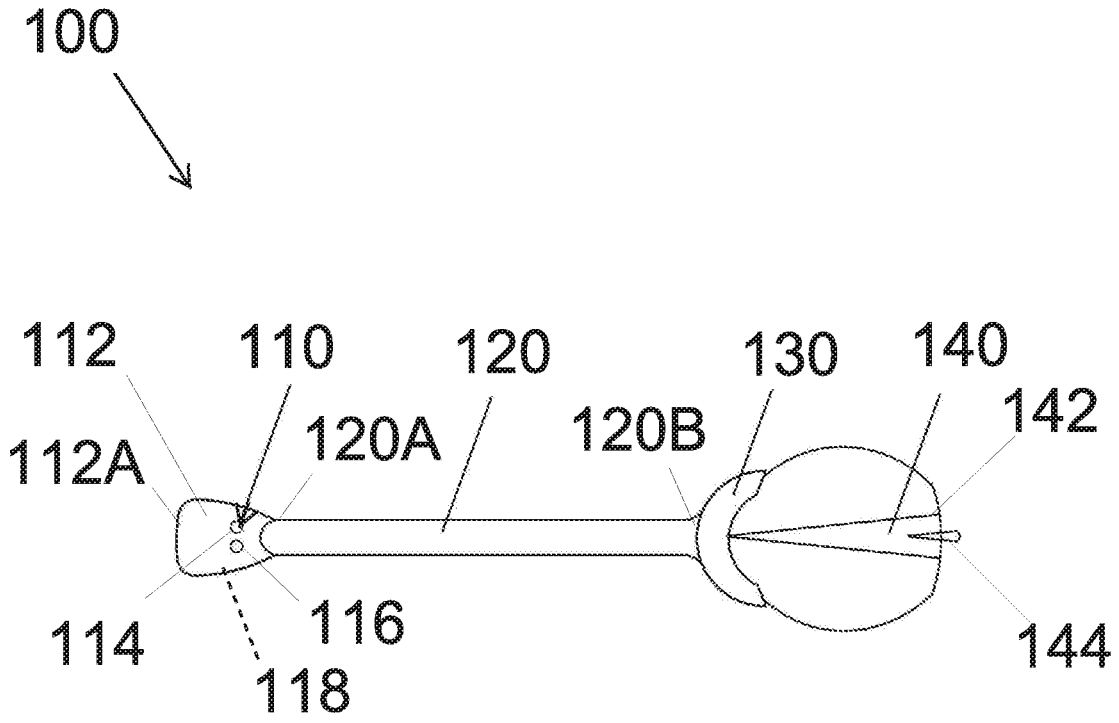
100
112
110
120
130
140
142
112A
120A
120B
114
116
118
144

ZIPPER ASSISTANT DEVICE

BACKGROUND OF THE INVENTION

Field of the Invention

The present invention is an assistant device. More specifically, the present invention is a zipper assistant device.

Description of the Related Art

Most single or elderly women with weakened strength often struggle to get dressed with little to no help, especially when it comes to zipping-up a back zipper. It's even more difficult to get to a full closure or even reach the midsection of the back zipper without becoming exhausted. The zipper assistant device may be a great benefit to this problem and create comfort for users.

What is needed is a zipper assistant device that provides consumers with an accessory to help conveniently zip-up their zippers which are often located on the back of clothing.

SUMMARY OF THE INVENTION

The present invention is an assistant device. More specifically, the present invention is a zipper assistant device.

The zipper assistant device includes an on and off switch having a casing, an ON button and an OFF button, the casing having a front facing and contains a battery to power the on and off switch, an elongated handle having a first end and a second end, the on and off switch attached to the first end of the elongated handle, a handle base attached to the second end of the elongated handle and a bulb-shaped magnetic field attached to the handle base opposite the elongated handle.

It is an object of the present invention to provide a zipper assistant device that provides consumers with an accessory to help conveniently zip-up their zippers which are often located on the back of clothing.

It is an object of the present invention to provide a zipper assistant device that may conveniently zip-up metal or magnetic zippers allowing comfort for individuals who have a hard time reaching their backs.

It is an object of the present invention to provide a zipper assistant device that is designed to grab a zip efficiently as well as have a battery-operated wand-shaped designed that switches on and off.

BRIEF DESCRIPTION OF THE DRAWINGS

The present invention will be described by way of exemplary embodiments, but not limitations, illustrated in the accompanying drawings in which like references denote similar elements, and in which:

FIG. 1 illustrates an exploded side view of a zipper assistant device, in accordance with one embodiment of the present invention.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention however the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

FIG. 1 illustrates an exploded side view of a zipper assistant device 100, in accordance with one embodiment of the present invention.

The zipper assistant device 100 may include an on and off switch 110, an elongated handle 120, a handle base 130 and a bulb-shaped magnetic field element 140.

The on and off switch 110 may have a casing 112, an ON button 114 and an OFF button 116. The casing 112 may have a front facing 112A and contain a battery 118 to power the on and off switch 110. The casing 112 may be made of metal, plastic or other suitable material. The ON button 116 may be disposed on the front facing 112A of the casing 112 and may be adapted to activate the zipper assistant device 100. The OFF button 116 may be disposed on the front facing 112A of the casing 112 and may be adapted to shut-off the zipper assistant device 100.

The elongated handle 120 may have a first end 120A and a second end 120B. The on and off switch 110 may be attached to the first end 120A of the elongated handle 120. The elongated handle 120 may be made of plastic, synthetic resin in the form of syrup for use in the industrial arts and further manufacture or LUCITE® or other suitable material.

The handle base 130 may be attached to the second end 120B of the elongated handle 120. The handle base 130 may be made of silver or other suitable material to conduct electricity while being non-magnetic.

The bulb-shaped magnetic field element 140 may be attached to the handle base 130 opposite the elongated handle 120 to provide stability to the bulb-shaped magnetic field element 140. The bulb-shaped magnetic field element 140 may include a middle magnetic field portion 142 that may be adapted to attach to and move a zipper 144 to open or close the zipper 144.

The zipper assistant device 100 functions as a battery-operated wand that includes an on and off switch 110. When the OFF button 116 is activated near a zipper 144, the bulb-shaped magnetic field element 140 magnetically attaches to the zipper 144 allowing the individual to finalize the look and closure of the outfit. The elongated handle 130 of the zipper assistant device 100 is made of LUCITE® and polystyrene plastic to give the handle base 130 a pleasant aesthetic look. Packaging for the zipper assistant device 100 would include a clear covering attached to the package with a picture of the woman zipping up her dress. Ingenious, practical and useful the zipper assistant device 100 is an innovative alternative without manually zipping-up zippers. The zipper assistant device 100 may appeal to manufacturers of apparel and accessories and may be partnered with a wide variety of stores including clothing stores, fabric store, tool shops and other specialized stores that sell similar products.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

What is claimed is:

1. A zipper assistant device, comprising:

an on and off switch having a casing, an ON button and an OFF button, the casing having a front facing and contains a battery to power the on and off switch, the ON button is disposed on the front facing of the casing and is adapted to activate the zipper assistant device, the OFF button is disposed on the front facing of the casing and is adapted to shut-off the zipper assistant device;

an elongated handle having a first end and a second end, the on and off switch attached to the first end of the elongated handle;

a handle base attached to the second end of the elongated handle; and a bulb-shaped magnetic field element attached to the handle base opposite the elongated handle to provide stability to the bulb-shaped magnetic field element, the bulb-shaped magnetic field element includes a middle magnetic field portion that is adapted to attach to and move a zipper to open or close the zipper.

2. The zipper assistant device according to claim 1, wherein the casing is made of plastic.

3. The zipper assistant device according to claim 1, wherein the casing is made of metal.

4. The zipper assistant device according to claim 1, wherein the elongated handle is made of plastic.

5. The zipper assistant device according to claim 4, wherein the elongated handle is made of Lucite.

6. The zipper assistant device according to claim 1, wherein the handle base is made of silver.

* * * * *